US007216691B2

(12) United States Patent
Grassi et al.

(10) Patent No.: US 7,216,691 B2
(45) Date of Patent: May 15, 2007

(54) MOLD-REMOVAL CASTING METHOD AND APPARATUS

(75) Inventors: John R. Grassi, Kennesaw, GA (US); John Campbell, West Malvern (GB); George W. Kuhlman, Coral Springs, FL (US)

(73) Assignee: Alotech Ltd. LLC, Kennesaw, GA (US)

( * ) Notice: Subject to any disclaimer, the term of this patent is extended or adjusted under 35 U.S.C. 154(b) by 232 days.

(21) Appl. No.: 10/614,601

(22) Filed: Jul. 7, 2003

(65) Prior Publication Data

US 2004/0050524 A1 Mar. 18, 2004

Related U.S. Application Data

(60) Provisional application No. 60/394,713, filed on Jul. 9, 2002.

(51) Int. Cl.
*B22D 29/00* (2006.01)
*B22C 9/02* (2006.01)

(52) U.S. Cl. ..... 164/131; 164/35; 164/522; 164/529

(58) Field of Classification Search ..... 164/131, 164/344, 345, 529, 361, 522, 35
See application file for complete search history.

(56) References Cited

U.S. PATENT DOCUMENTS

| | | | | |
|---|---|---|---|---|
| 22,865 | A | 2/1859 | Gardiner | |
| 185,376 | A | 12/1876 | Whitehouse | |
| 381,655 | A | 4/1888 | Stover | |
| 927,495 | A | 7/1909 | Custer | |
| 1,241,867 | A | 10/1917 | McMillen | |
| 2,968,848 | A * | 1/1961 | Carter | 164/128 |
| 3,124,452 | A | 3/1964 | Kraft | |
| 3,540,519 | A | 11/1970 | Yates | |
| 3,620,291 | A | 11/1971 | Delachapelle | |
| 3,863,702 | A | 2/1975 | Hallerberg et al. | |
| 3,958,619 | A | 5/1976 | Petersen et al. | |
| 4,222,429 | A | 9/1980 | Kemp | |
| 4,347,890 | A | 9/1982 | Ailin-Pyzik et al. | |
| 4,399,858 | A | 8/1983 | Kurabe et al. | |

(Continued)

FOREIGN PATENT DOCUMENTS

| | | |
|---|---|---|
| CH | 622 726 | 4/1981 |

(Continued)

OTHER PUBLICATIONS

Patent Abstracts of Japan, vol. 10, No. 118, May 2, 1986 & JP 60 247458 (Mazda KK), Dec. 7, 1985.

(Continued)

*Primary Examiner*—Kevin Kerns
*Assistant Examiner*—I.-H. Lin
(74) *Attorney, Agent, or Firm*—Fay, Sharpe, Fagan, Minnich & McKee, LLP

(57) ABSTRACT

A process for the casting of metals includes the steps of providing a mold, delivering a molten metal into the mold, solidifying the molten metal, and removing at least a portion of the mold. The step of removing at least a portion of the mold begins before the step of solidifying the molten metal has been finished. An apparatus to deliver a solvent to a mold is also provided.

46 Claims, 5 Drawing Sheets

U.S. PATENT DOCUMENTS

| | | | | | |
|---|---|---|---|---|---|
| 4,548,256 | A | | 10/1985 | Glinn et al. | |
| 4,582,118 | A | | 4/1986 | Jacoby et al. | |
| 4,607,091 | A | | 8/1986 | Schreiber | |
| 4,610,295 | A | | 9/1986 | Jacoby et al. | |
| 4,629,708 | A | | 12/1986 | Alexander et al. | |
| 4,709,740 | A | | 12/1987 | Jacoby et al. | |
| 4,724,887 | A | | 2/1988 | Jacoby et al. | |
| 4,802,525 | A | | 2/1989 | Heine et al. | |
| 4,971,134 | A | * | 11/1990 | Kawaguchi et al. | 164/122 |
| 4,987,950 | A | | 1/1991 | Yu | |
| 5,143,665 | A | | 9/1992 | Clubbs et al. | |
| 5,148,853 | A | | 9/1992 | Yu et al. | |
| 5,158,130 | A | * | 10/1992 | Sahari | 164/528 |
| 5,294,648 | A | | 3/1994 | Smith et al. | |
| 5,327,955 | A | | 7/1994 | Easwaran | |
| 5,333,673 | A | | 8/1994 | Hughes | |
| 5,439,045 | A | | 8/1995 | Crafton | |
| 5,573,055 | A | | 11/1996 | Melling et al. | |
| 5,641,015 | A | * | 6/1997 | Challand | 164/528 |
| 5,681,407 | A | | 10/1997 | Yu et al. | |
| 5,725,044 | A | | 3/1998 | Hirokawa | |
| 5,738,162 | A | | 4/1998 | Crafton | |
| 5,810,918 | A | | 9/1998 | Landis | |
| 5,820,705 | A | | 10/1998 | Yu et al. | |
| 5,913,354 | A | | 6/1999 | Conroy et al. | |
| 5,915,452 | A | * | 6/1999 | Conroy et al. | 164/345 |
| 5,957,188 | A | | 9/1999 | Crafton | |
| 6,139,619 | A | | 10/2000 | Zaretskiy et al. | |
| 6,336,809 | B1 | | 1/2002 | Crafton et al. | |
| 6,390,178 | B1 | | 5/2002 | Makino | |
| 6,447,593 | B1 | | 9/2002 | Sargent et al. | |
| 6,469,299 | B2 | | 10/2002 | Chutjian et al. | |
| 6,547,556 | B2 | | 4/2003 | Crafton et al. | |
| 6,551,396 | B1 | * | 4/2003 | Pineda et al. | 106/38.9 |
| 6,622,775 | B2 | | 9/2003 | Crafton et al. | |
| 6,672,367 | B2 | | 1/2004 | Crafton et al. | |
| 2002/0020511 | A1 | | 2/2002 | Crafton et al. | |
| 2002/0104596 | A1 | | 8/2002 | Crafton et al. | |
| 2004/0055728 | A1 | | 3/2004 | Lewis, Jr. et al. | |
| 2005/0022957 | A1 | | 2/2005 | Crafton et al. | |
| 2005/0072549 | A1 | | 4/2005 | Crafton et al. | |
| 2005/0145362 | A1 | | 7/2005 | Crafton et al. | |

FOREIGN PATENT DOCUMENTS

| | | | | | |
|---|---|---|---|---|---|
| CH | 622 726 | A5 | | 4/1981 | |
| DE | 32 15 809 | | | 11/1983 | |
| DE | 36 16 168 | | | 11/1987 | |
| EP | 0 141 666 | | | 5/1985 | |
| EP | 0 141 666 | A2 | | 5/1985 | |
| EP | 0 119 365 | | | 9/1987 | |
| EP | 0 744 233 | | | 11/1996 | |
| EP | 0 744 233 | A2 | | 11/1996 | |
| FR | 2 614 814 | | | 11/1988 | |
| GB | 1 549 220 | | | 7/1979 | |
| GB | 2 248 569 | A | | 4/1992 | |
| JP | 359156566 | | * | 9/1984 | 164/35 |
| JP | 5-169185 | | | 7/1993 | |

OTHER PUBLICATIONS

Patent Abstracts of Japan; Publication No. 61007058; Publication Date Jan. 13, 1986.

Patent Abstracts of Japan, JP-60247458 (Mazda Motor Corp.) Dec. 7, 1985.

Niedling, Jake J. et al., "Evaluating RSI Sows For Safe Charging Into Molten Metal", Light Metals 2003, TMS (The Minerals, Metals & Materials Society), 2003, pp. 695-700.

Ekenes, J. Martin et al., "Cause and Prevention of Explosions Involving Hot-Top Casting of Aluminum Extrusion Ingot", Light Metals 2003, TMS (The Minerals, Metals & Materials Society), 2003, pp. 687-693.

* cited by examiner

MOLD-REMOVAL CASTING METHOD AND APPARATUS

CROSS-REFERENCE TO RELATED APPLICATION

This application claims the benefit of U.S. Provisional Application Ser. No. 60/394,713, filed on Jul. 9, 2002.

FIELD OF THE INVENTION

The present invention relates to the casting of metals. More particularly, the present invention relates to a method and an apparatus for a mold-removal casting of metals.

BACKGROUND OF THE INVENTION

In the traditional casting process, molten metal is poured into a mold and solidifies, or freezes, through a loss of heat to the mold. When enough heat has been lost from the metal so that it has frozen, the resulting product, i.e., a casting, can support its own weight. The casting is then removed from the mold.

Different types of molds of the prior art offer certain advantages. For example, green sand molds are composed of an aggregate, sand, that is held together with a binder such as a mixture of clay and water. These molds may be manufactured rapidly, e.g., in ten (10) seconds for simple molds in an automated mold making plant. In addition, the sand can be recycled for further use relatively easily.

Other sand molds often use resin based chemical binders that possess high dimensional accuracy and high hardness. Such resin-bonded sand molds take somewhat longer to manufacture than green sand molds because a curing reaction must take place for the binder to become effective and allow formation of the mold. As in clay-bonded molds, the sand can often be recycled, although with some treatment to remove the resin.

In addition to relatively quick and economical manufacture, sand molds also have high productivity. A sand mold can be set aside after the molten metal has been poured to allow it to cool and solidify, allowing other molds to be poured.

The sand that is used as an aggregate in sand molding is most commonly silica. However, other minerals have been used to avoid the undesirable transition from alpha quartz to beta quartz at about 570 degrees Celsius (° C.), or 1,058 degrees Fahrenheit (° F.), that include olivine, chromite and zircon. These minerals possess certain disadvantages, as olivine is often variable in its chemistry, leading to problems of uniform control with chemical binders. Chromite is typically crushed, creating angular grains that lead to a poor surface finish on the casting and rapid wear of tooling. Zircon is heavy, increasing the demands on equipment that is used to form and handle a mold and causing rapid tool wear.

In addition the disadvantages created by the unique aspects of silica and alternative minerals, sand molds with clay and chemical binders typically do not allow rapid cooling of the molten metal due to their relatively low thermal conductivity. Rapid cooling of the molten metal is often desirable, as it is known in the art that with such cooling the mechanical properties of the casting are improved. In addition, rapid cooling allows the retention of more of the alloying elements in solution, thereby introducing the possibility of eliminating subsequent solution treatment, which saves time and expense. The elimination of solution treatment prevents the quench that typically follows, removing the problems of distortion and residual stress in the casting that are caused by the quench.

As an alternative to sand molds, molds made of metal or semi-permanent molds or molds with chills are sometimes used. These metal molds are particularly advantageous because their relatively high thermal conductivity allows the cast molten metal to cool and solidify quickly, leading to advantageous mechanical properties in the casting. For example, a particular casting process known as pressure die casting utilizes metal molds and is known to have a rapid solidification rate. Such a rapid rate of solidification is indicated by the presence of fine dendrite arm spacing (DAS) in the casting. As known in the art, the faster the solidification rate, the smaller the DAS. However, pressure die casting often allows the formation of defects in a cast part because extreme surface turbulence occurs in the molten metal during the filling of the mold.

Moreover, all molds made from metal possess a significant economic disadvantage. Because the casting must freeze before it can be removed from the mold, multiple metal molds must be used to achieve high productivity. The need for multiple molds in permanent mold casting increases the cost of tooling and typically results in costs for tooling that are at least five times more than those associated with sand molds.

As a result, it is desirable to develop a casting process and related apparatus that have the advantage of rapid solidification of metal molds, while also having the lower costs, high productivity and reclaim-ability associated with sand molds.

BRIEF SUMMARY OF THE INVENTION

In an exemplary embodiment of the present invention, a process for the casting of metals is provided. The process includes the steps of providing a mold, delivering a molten metal into the mold, solidifying the molten metal, while removing at least a portion of the mold. The step of removing at least a portion of the mold begins before the step of solidifying the molten metal has been completed.

In another exemplary embodiment of the present invention, a process for reducing the cooling time of a metal that has been cast is provided. The process includes the steps of providing a mold, supplying molten metal to the mold and spraying the mold with a solvent, decomposing at least a portion of the mold with the solvent and cooling the molten metal with the solvent.

In yet another exemplary embodiment of the present invention, an apparatus for delivering a solvent to a mold for the casting of metals is provided. The apparatus includes at least one nozzle that has a solvent delivery rate of from about 0.5 to about 50.0 liters per second and a solvent delivery pressure of from about 0.03 bar to about 70.00 bar, whereby the mold is at least partly dissolved or removed by the solvent that is delivered while the casting is cooled.

In still another exemplary embodiment of the present invention, a molding device includes a source of molten metal and a mold for holding a charge of molten metal from the source of molten metal. An apparatus is provided for at least partly decomposing the mold. The apparatus comprises a housing, a spray nozzle mounted on the housing for spraying a solvent onto the mold and a control operatively connected with the spray nozzle for controlling at least one of a delivery pressure and a delivery rate of the solvent being sprayed by the spray nozzle.

BRIEF DESCRIPTION OF THE DRAWINGS

The invention may take physical form in certain parts and arrangement of parts or certain process steps, a preferred embodiment of which will be described in detail in this specification and illustrated in the accompanying drawings, which form a part hereof and wherein.

DETAILED DESCRIPTION OF THE INVENTION

Figure 1:
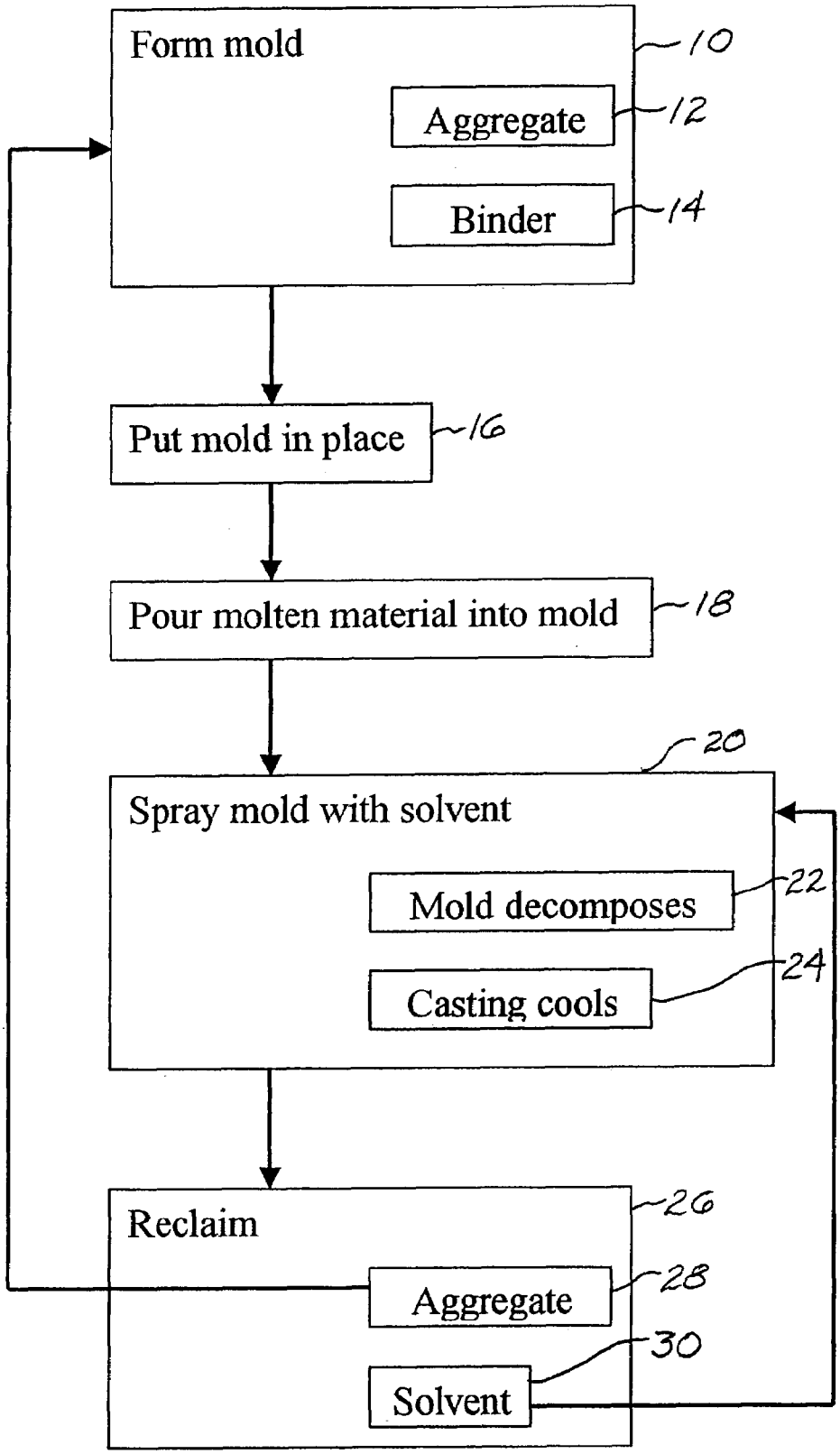
FIG. 1 is a flow chart of the steps associated with one embodiment of the present invention.

Referring now to the drawings, wherein the showings are for purposes of illustrating the preferred embodiment of the invention and not for the purposes of limiting the same, FIG. 1 illustrates the steps of the process of the invention. It is to be noted that the invention is suitable for the casting of any metal, including non-ferrous alloys based on magnesium, aluminum and copper, as well as ferrous alloys and high temperature alloys such as nickel-based and similar alloys. First, a mold is formed, step 10.

The mold is composed of an aggregate 12 and a binder 14. The aggregate 12 includes a material having a minimal thermal capacity and/or minimal thermal conductivity to reduce the heat that is extracted from the cast molten metal. By reducing the heat that is extracted, the molten metal does not solidify prematurely and thus flows smoothly into all portions of large molds and thin areas. The aggregate 12 may also have a low coefficient of thermal expansion and no phase change, allowing use of the mold to high temperatures while retaining high dimensional accuracy.

The aggregate 12 may be composed of approximately spherical particles, which impart a good surface finish to the casting and minimize tool wear. The size of the particles should be fine enough to allow the creation of a good surface finish on the casting, but the size may be increased if the mold is to be permeable to vent gases.

One exemplary material that may be used for the aggregate 12 is silica sand. As previously described, silica sand may possess some disadvantages, but does have many desirable characteristics as an aggregate 12, including a smooth particle shape, small particle size, low cost and good thermal properties up to its alpha/beta quartz transition temperature.

The aggregate 12 is bonded with a binder 14 that is soluble. The binder 14 may be an inorganic material that will pick up little or no hydrogen, preventing detrimental exposure of the molten metal to hydrogen. As a result, the binder may contain no water or hydrocarbons. Such a lack of water or hydrocarbons also allows the mold to be dried at high temperatures or heated up to the casting temperature of the metal, well above the boiling point of water. The binder 14 may also have low gas evolution when the molten metal is cast, reducing the need for a mold or mold cores that are permeable. The avoidance of a permeable mold allows the use of more finely sized particles for the aggregate 12, which is advantageous, as described above.

An exemplary binder 14 possessing the described characteristics is based on phosphate glass, a binder that is known in the art. Phosphate glass is an amorphous, water soluble material that includes phosphoric oxide, $P_2O_5$, as the principal constituent with other compounds such as alumina and magnesia or sodium oxide and calcium oxide. Other exemplary binders 14 include inorganic silicates, such as sodium silicate, magnesium sulfates and other salts and borates. Further exemplary binders 14 include systems wherein an organic binder, such as urethane, is added to a known inorganic binder and the organic binder is in the range of from about 1 weight percent (wt. %) to about 51 wt. % of the binder system.

Once the mold is formed, at step 10, it is put in place so that it may be filled with a molten metal, at step 16. For example, the mold may be held above the floor of a foundry as known in the art. The molten metal is poured into the mold, at step 18. The mold may be designed to allow the molten metal to flow according to gravity, known in the art as gravity pouring.

After pouring the metal into the mold, at step 18, the mold is subjected to the action of a solvent, such as by spraying, at step 20. As mentioned, the binder 14 is soluble. Thus, the solvent dissolves the binder and thereby causes the mold to decompose 22. As the mold decomposes 22, the casting is exposed to the solvent, which causes it to cool rapidly and solidify 24. The casting is thus separated from the mold and simultaneously cooled in a rapid manner, resulting in a casting that has been made with an inexpensive mold and has solidified rapidly, thereby having advantageous mechanical properties. Moreover, the delivery of a solvent in a manner such as spraying may have a strong zonal cooling effect on the cast metal, encouraging the whole casting to solidify progressively, thereby facilitating feeding and securing the soundness of the casting.

An exemplary solvent is water. Water is environmentally acceptable and has high heat capacity and latent heat of evaporation, allowing it to absorb a significant amount of heat before evaporating. It can thus provide an optimum cooling effect to enable rapid solidification of the cast metal.

Other solvents may include liquids or gases that decompose the binder 22 and cool the cast metal 24. For example, known quenching agents may be used with appropriately soluble binders. Moreover, a grit may be entrained in the cooling fluid (liquid or gas) and used to decompose the mold 22 by abrasion, at the same time as the mold is being washed away by the fluid. The grit may also serve a second purpose, namely to allow the cast metal to be peened by the grit as it is cooled 24, yielding additional advantageous surface properties.

As the mold decomposes 22 when it is sprayed with the solvent 20, at least some of the mold constituents may be reclaimed, step 26. The aggregate can be gathered 28 for drying and re-use. Moreover, the solvent can be collected 30, filtered and recirculated for further use. In some systems, it may also be possible to reclaim the binder as well through a reclamation system as known in the art.

Figure 2:
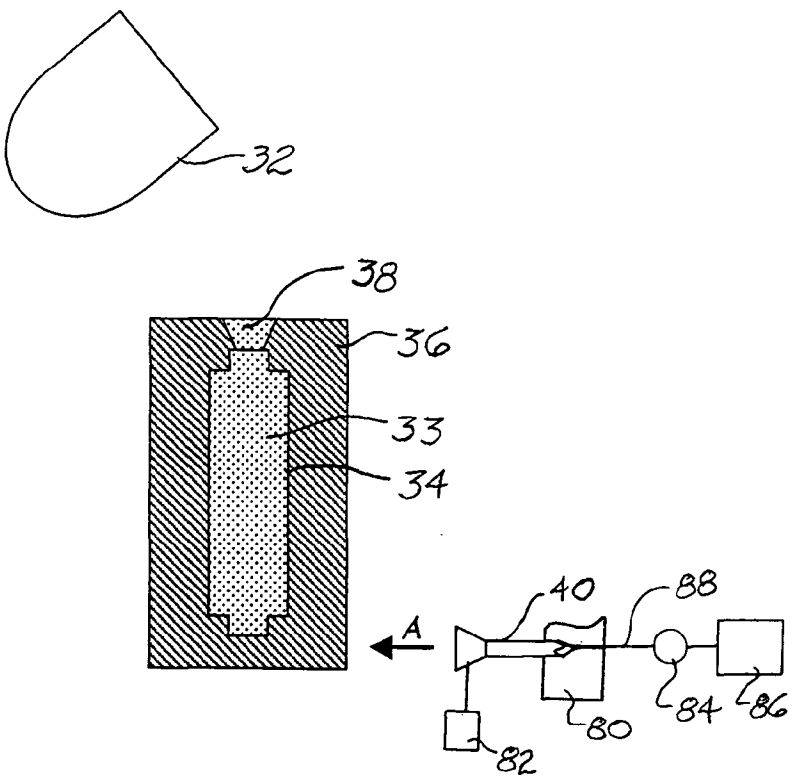
FIG. 2 is a schematic side view of a layout of another embodiment of the present invention.

Turning now to FIG. 2, a schematic illustrating the apparatuses involved with the step 20 (referring back to FIG. 1) of subjecting the mold to a solvent is provided. A crucible or ladle 32 has been used to pour molten metal 33 into a mold cavity 34 that is defined by a mold 36 of the above-described aggregate and binder composition. A riser 38 is the last portion to be cast. A spray nozzle 40 directs a jet of solvent A, such as water, at the mold 36. The jet A may be delivered in any suitable configuration from a narrow stream to a wide fan and may be a steady stream or a pulsating stream, as dictated by the particular application.

The delivery of solvent, i.e., the spray, may begin at the base of the mold 36. The mold 36 is lowered to allow the nozzle 40 to deliver the solvent in a progressive manner to intact portions of the mold 36 so that the mold 36 entirely decomposes. In the alternative, the mold 36 may remain stationary and the nozzle 40 may be caused to move in order to progressively deliver a solvent jet A to decompose at least part of the mold 36. In order to allow the entire circumference of the mold 36 to be contacted by the jet A for rapid decomposition, the mold 36 may be rotated or the spray nozzle 40 may be moved about the mold 36.

The rate and pressure of delivery of the jet A are of a setting that is high enough to decompose the mold 36, yet low enough to allow the solvent to percolate through the mold 36 so that percolated solvent arrives at the cast metal 33 ahead of the full force of the jet A. For example, high volume, low pressure delivery in a range of about 0.5 to 50 liters per second, lps (10 to 100 gallons per minute, gpm) at a pressure ranging from 0.03 to 70 bar (0.5 to about 1,000 pounds per square inch, psi) may be advantageous. In this manner, the percolated solvent causes the formation of a relatively solid skin on the cast metal 33 before the metal 33 is contacted by the force of the jet A, thereby preventing distortion of the metal 33 or explosion from excessive direct contact of the solvent with the molten metal 33. The addition of a surfactant, as known in the art, to the solvent in the jet A or to the binder formulation may enhance percolation of the solvent through the mold 36. In addition, at least some of the heat that is absorbed from the molten metal 33 by the mold 36 may increase the temperature of the solvent as the solvent percolates through the mold 36, thereby increasing the energy of the solvent and causing it to remove the mold 36 more rapidly.

An additional consideration for the rate and pressure of the delivery of the jet A is the contact with the cast metal 33 once the mold 36 has decomposed. The rate and pressure of the jet A must be low enough to prevent damage to the casting 33, but must be high enough to overcome the formation of a vapor blanket. A vapor blanket is formed by the evaporation of the solvent that has percolated through the mold 36 to contact the metal 33 in forming the skin on the casting 33. The vapor blanket reduces the transfer of heat away from the cast metal 33 and is detrimental to the rapid cooling that is necessary to obtain the desirable properties and effects that are described above. Thus, it is advantageous to adjust the jet A to overcome the vapor blanket.

Control of the jet A may be exercised in at least two ways. The rate and pressure of delivery may be set to achieve all of the above parameters, or two separate settings may be used. If two separate settings are used, one setting may be established for decomposition of the mold 36 and a separate, reduced setting may be timed to replace the decomposition setting when the jet A is about to contact the cast metal 33. Of course, the manner in which the jet A is delivered, i.e., narrow stream, wide fan, steady flow, intermittent pulse, etc., will likely affect the rate and pressure settings of the jet A accordingly.

The solidification of the casting 33 beginning at its base and progressing to its top allows the riser 38 to remain in a molten state for the maximum length of the time so that it may continue to feed the casting 33. By feeding the casting 33 for a longer period of time, voids created by shrinkage of the metal 33 upon cooling are minimized. Solidification from the base of the casting 33 to the top also allows length or longitudinal changes to take place before solidification is complete, thereby eliminating any significant buildups of internal stress that often occur in quenching.

It is important to note that a single nozzle 40 is not limited to a base-to-top direction of spray as described above. Depending on the application, it may be desirable to spray the jet A from the top of the mold 36 to the bottom, from a midpoint to one end, or in some similar pattern.

Figure 3:
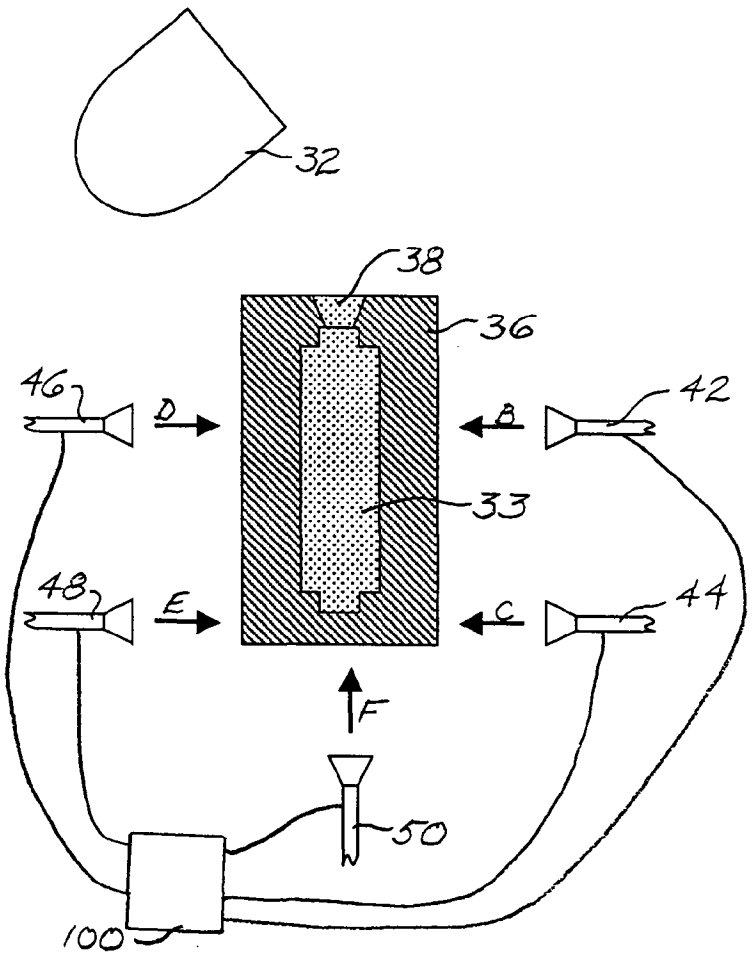
FIG. 3 is a schematic side view of a layout of another embodiment of the present invention.

With reference to FIG. 3, the application of solvent is not limited to a single direction or nozzle. For example, two or more nozzles 42, 44, 46, 48 and 50 may be present, removing the mold 36 from multiple directions. Each nozzle 42, 44, 46, 48 and 50 can spray a respective jet B, C, D, E and F at the mold 36. In this manner, the mold 36 may be decomposed more rapidly and uniformly, if desired in a particular application. Any number of nozzles may be present, as a great number of nozzles may be advantageous for large or complex molds 36 or a few nozzles may provide optimum coverage for other molds 36. As in FIG. 2, the mold 36 may be rotated and moved vertically to allow complete distribution of the jets B, C, D, E and F, or the nozzles 42, 44, 46, 48 and 50 may be moved while the mold 36 and casting 33 remain stationary.

In addition, when multiple nozzles 42, 44, 46, 48 and 50 are used, it may be advantageous to time the function of the nozzles 42, 44, 46, 48 and 50 to complement one another. For example, the bottom nozzle 50 may be engaged, thereby spraying the jet F at the bottom of the mold 36. The bottom nozzle 50 may be turned off and lower side nozzles 44 and 48 may be engaged to spray jets C and E at the mold 36, and so on. Such coordinated timing of multiple nozzles may optimize the decomposition of the mold 36 and/or the direction of cooling of the cast metal 33 to provide the desired characteristics of the casting 33.

With reference again to FIG. 2, the nozzle 40 can be mounted on a housing 80, which allows relative movement between the nozzle and the mold 36. Also, a control 82 can be operatively associated with the nozzle 40 to regulate the spray of solvent through the nozzle. A pump 84 can be employed to feed solvent from a reservoir 86 to the nozzle via a conduit 88. The conduit 88 can be flexible to allow movement of the housing 80 in relation to the reservoir 86. With reference now again to FIG. 3, a regulator 100 can be used to selectively actuate the several nozzles 42–50 in a desired sequence or order.

To illustrate the design and the effect of the process and apparatuses of the present invention, reference is made to the following examples. It is to be understood that the present invention is not limited to the examples, and various changes and modifications may be made in the invention without departing from the spirit and scope thereof. Although the following examples are described with reference to aluminum alloys, as mentioned above, the invention is suitable for the casting of a wide variety of metals and alloys.

EXAMPLES

Example 1

Prior Art Cooling

Figure 4:
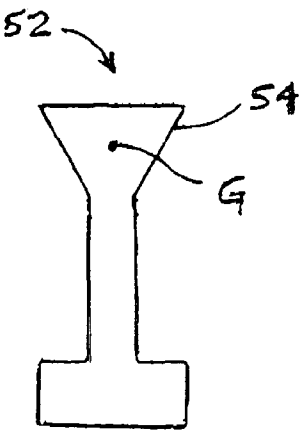
FIG. 4 PRIOR ART
FIG. 4 is a side view of a test specimen treated in accordance with a method of the prior art.

FIG. 4 is a side view of a first cast specimen 52. The first specimen 52 was of 6061 aluminum and included a riser 54 in which a thermocouple was placed at point G. The first specimen 52 was formed by heating the aluminum to a temperature of about 720° C. (1,328° F.) in an electric-heated crucible. The aluminum was poured into a gravity-fed mold that was pre-heated to about 177° C. (350° F.) and was composed of an aggregate of silica sand having an average grain size of about 150 micrometers (μm) and a binder based on a phosphate glass.

The sand was Wedron 505 sand and the binder was obtained from MA International of Chicago, Ill., which sells the binder under the trade name Cordis #4615. The binder was approximately 1% of the weight of the mold. Approximately 2.99 kilograms, kg (6.6 pounds, lbs) of Wedron 505 sand was mixed with 29.9 grams, g (0.066 lbs) of Cordis #4615 binder. The mixing was performed by an electric hand blender and the mold was baked for 30 minutes at about 149° C. (300° F.).

The specimen 52 was poured within 10 seconds of removal of the crucible from heat. The diameter of the middle section of the first specimen 52 was approximately 20 millimeters (mm) and the length of the specimen 52 was about 120 mm. During pouring, the mold was held at a temperature of 65° C. (150° F.).

Figure 5:
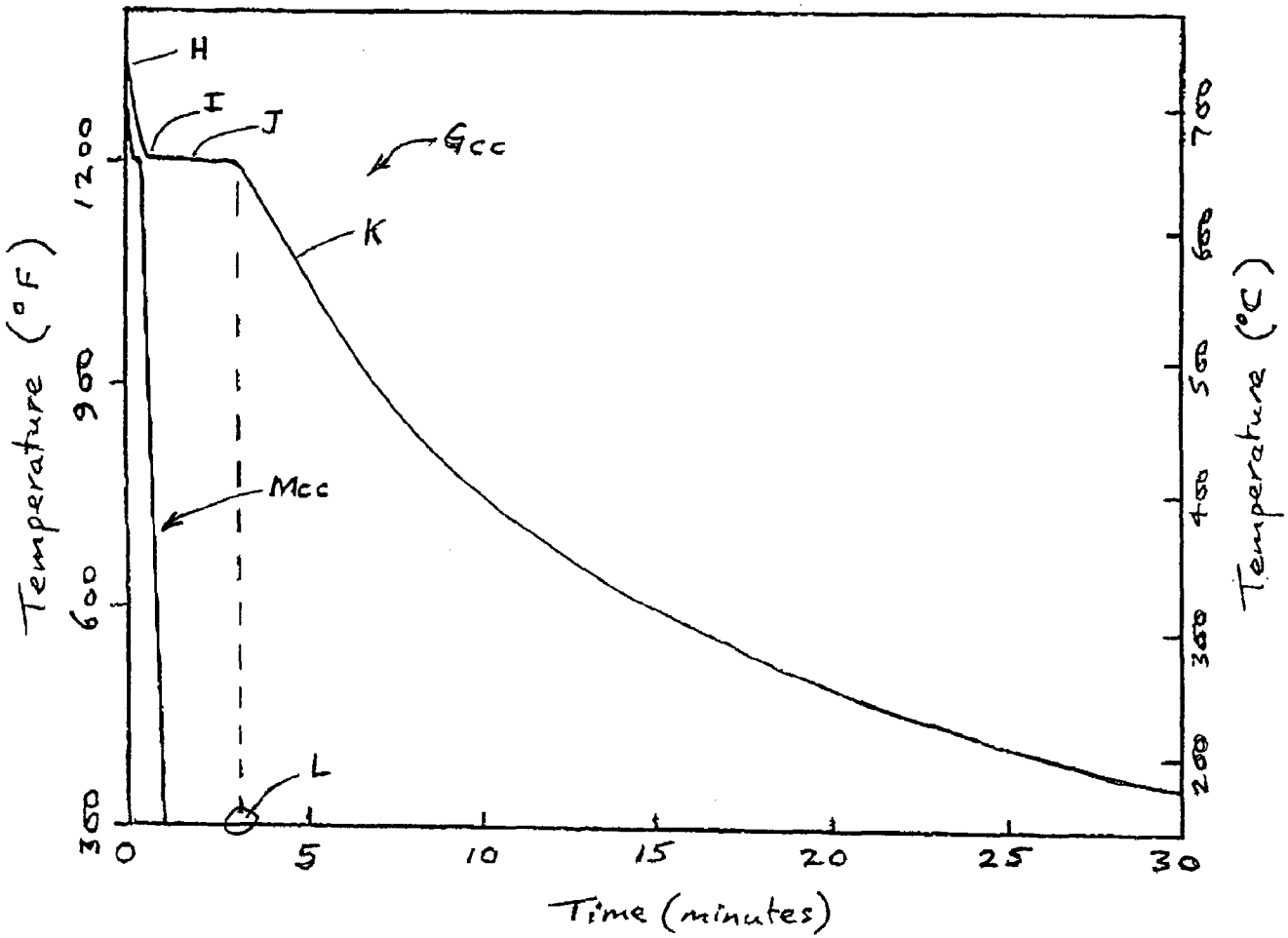
FIG. 5 PRIOR ART
FIG. 5 is a graphical representation of a cooling curve of the test specimen of FIG. 4, illustrating a cooling curve of the prior art.

Upon casting, the first specimen 52 was left to cool to ambient temperature according to the prior art and the cooling curve shown in FIG. 5 was generated by the thermocouple at point G (referring back to FIG. 4). The cooling curve $G_{cc}$ includes a pouring temperature H of about 720° C. (1,328° F.) and a solidification or freezing temperature I of about 650° C. (1,200° F.). At the freezing temperature I a thermal arrest plateau J was reached. When the thermal arrest plateau J ended, the first cast specimen 52 was sufficiently cooled to allow it be removed from its mold. The remainder of the curve K represents the final cooling of the specimen 52. The time to solidification L was just over three minutes. A cooling curve $M_{cc}$ of the present invention, to be described in Example 2 below, is shown for reference only.

Example 2

Exemplary Embodiment of the Present Invention

Figure 6:
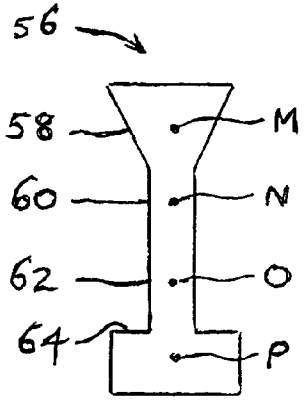
FIG. 6 is a side view of a test specimen treated in accordance with an embodiment of the present invention.

FIG. 6 is a side view of a second cast specimen 56. The second specimen 56 was of 6061 aluminum and included a riser 58 in which a thermocouple was placed at point M. The second specimen also included an upper middle section 60, a lower middle section 62 and a bottom 64. Thermocouples were placed at points N, O and P, in the upper middle 60, the lower middle 62 and the bottom 64 of the second specimen 56, respectively.

The second specimen 56 was formed by heating the aluminum to a temperature of about 720° C. (1,328° F.) in an electric-heated crucible. The aluminum was poured into a gravity-fed mold that was pre-heated to about 177° C. (350° F.) and was composed of an aggregate of silica sand having an average grain size of about 150 μm and a binder of phosphate glass, as in the first example. The specimen 56 was poured within 10 seconds of removal of the crucible from heat. The fill time of the mold was about 3 seconds. The diameter of the middle section of the second specimen 56 was approximately 20 mm and the length of the specimen 56 was about 120 mm. The mold, during pour, was held at a temperature of about 65° C. (150° F.).

Immediately after the molten metal was poured, i.e., within 10 seconds after the mold was filled, 0.5 liters per second of water was directed at the base of the mold through a single horizontal fan jet. High-volume, low-pressure water was used to remove the mold. Specifically, water was delivered at a pressure of about 70 bar (1,000 psi) by, for example, a 5 kilowatt (kW) or 5 horsepower (hp) water sprayer. The water was mains or tap water at ambient temperature and was sprayed in a flat fan spray pattern wide enough to encompass the width of the mold. The dimensions of the water jet at the point at which it struck the mold were 4 mm by 35 mm. The jet was progressively raised over a period of approximately 45 seconds to the top of the mold, so that the mold was washed away.

The water, or other fluid, can be sprayed at varying pressures and rates. A range that has proven satisfactory for the casting of Example 2 ranges from a minimum of about 4 liters (1 gallon) at about 3 bar (40 psi) to about 11 liters (3 gallons) at about 100 bar (1,500 psi).

It should also be appreciated that the casting can be further cooled after the mold is removed by continuing to spray the casting with a cooling fluid. The humidity of the environment does not appear to matter significantly in the removal of the mold. However, maintaining a high humidity or pre-wetting the mold may speed the removal process.

Figure 7:
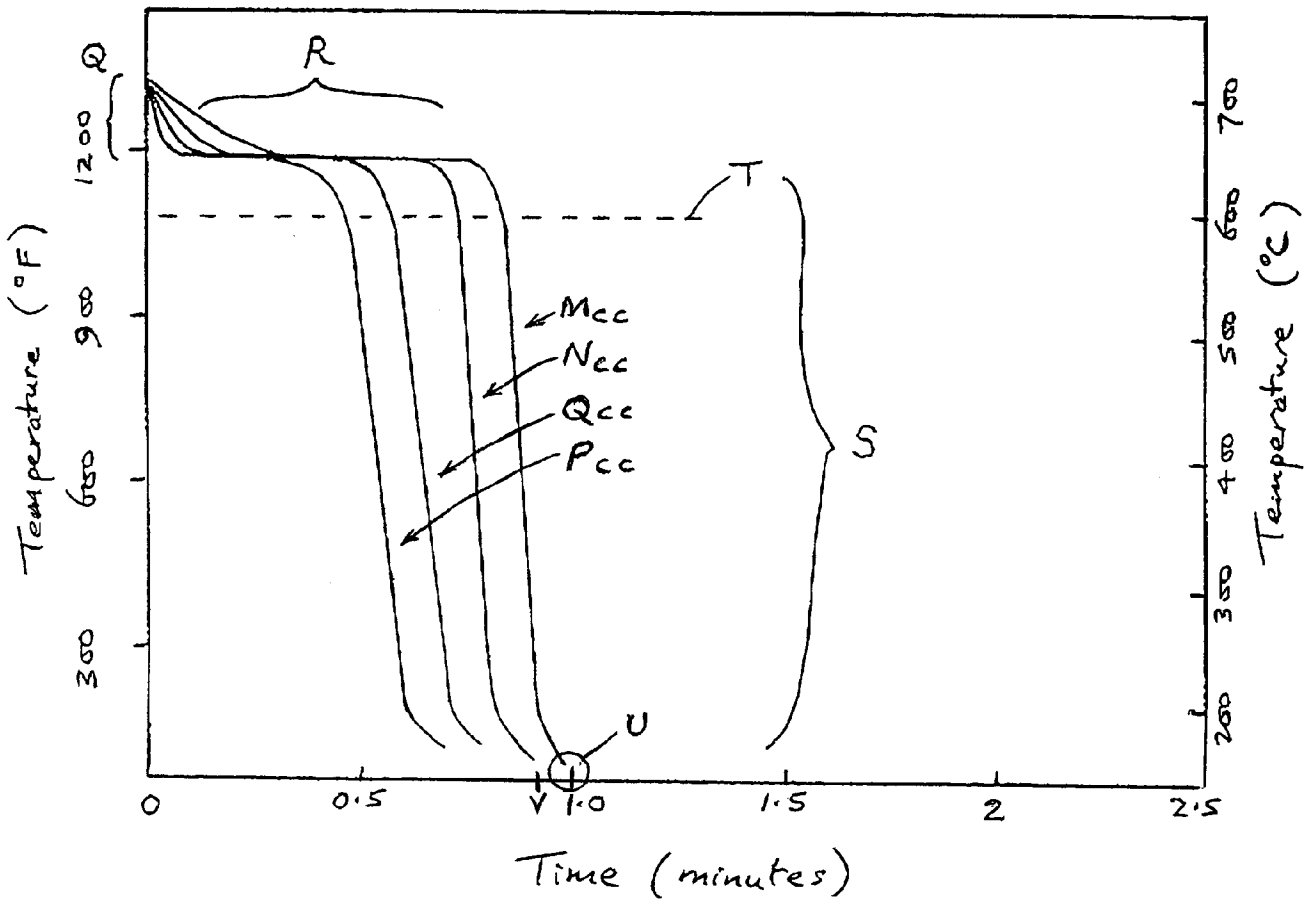
FIG. 7 is a graphical representation of a cooling curve of the test specimen of FIG. 6, illustrating a cooling curve of the present invention; and, FIG. 8 is a schematic representation of the layout of yet another embodiment of the present invention.

FIG. 7 shows the cooling curves generated by the thermocouples placed at points M, N, O and P in the second specimen 56 (referring back to FIG. 6). The cooling curve at point M in the riser 58 is designated as $M_{cc}$, while the curve at point N in the upper middle section 60 is designated as $N_{cc}$, the curve at point O in the lower middle section 62 is designated as $O_{cc}$ and the curve at point P in the bottom 64 of the specimen 56 is designated as $P_{cc}$. All of the cooling curves $M_{cc}$, $N_{cc}$, $O_{cc}$ and $P_{cc}$ had a pour temperature between about 650° C. (1,200° F.) and just over 700° C. (1,300° F.). As in the prior example, the pour temperature Q at the riser 58 is over 700° C. (1,300° F.). The thermal arrest plateaus R for the cooling curves $M_{cc}$, $N_{cc}$, $O_{cc}$ and $P_{cc}$ were at or slightly below 650° C. (1,200° F.), as in the prior example. However, the thermal arrest plateaus R ended relatively quickly, with final cooling S rapidly passing through the solidus temperature T of 582° C. (1,080° F.) and to room temperature in an extremely short amount of time U, a time of about one minute.

It is important to note the time to solidification, i.e., the time at which each thermal arrest plateau R ended, varied along the specimen 56 according to the order of cooling. The thermal arrest plateau R for the cooling curve at point P, the first area to be cooled, ended after about 30 seconds. The thermal arrest plateau R for the cooling curve at point O, the second area to be cooled, ended after about 40 seconds. The thermal arrest plateau R for the cooling curve at point N, the third area to be cooled, ended after about 45 seconds. Finally, the thermal arrest plateau R for the cooling curve at point M, the last area to be cooled, ended at V, a time of about 53 seconds.

As shown by way of the above examples, the time to solidification L (referring to FIG. 5) is about three minutes, while the comparable time to solidification of the present invention V (referring to FIG. 7) is under one minute. Also, the time needed to completely cool the casting is drastically reduced, from over an hour for the prior art of FIG. 5 to about one minute for the present invention, as shown in FIG.

7 at U. The rate of cooling is estimated to be on the order of 30 to 50° C. per second (60 to 100° F. per second) in the solid portion of the casting.

Moreover, the DAS of the first specimen 52 was measured and found to be approximately 70 μm, while the DAS of the second specimen 56 was about 20 μm. As noted above, the faster the solidification rate, the smaller the DAS. The second specimen 56 of the present invention has a DAS that is significantly smaller than that of the prior art specimen 52 and is equal to or smaller than that found in rapidly cooled casting processes of the prior art, such as pressure die casting. However, because the mold may be gravity fed, the problems associated with the turbulence induced in the molten metal in pressure die casting are avoided. The grain size of the 6061 aluminum casting according to the present invention was found to be about 45 μm with no grain refiner added. This is considered to be a fine grain size, allowing the casting to resist fatigue better than castings of the prior art.

While the wrought aluminum alloy 6061 has been discussed in the examples herein, the process of the present invention may also be suitable for other wrought alloys, particularly the 7000 series aluminum alloys that normally have very long freezing rates. The very fast solidification rates according to the present invention would enable the casting of these long freezing rate alloys. Due to the fast quenching rates, on the order of 30 to 50° C. per second (60 to 100° F. per second), the present invention may reduce or eliminate solution or aging treatment times, thereby providing a cost savings. The process may also be useful in 2000 wrought series aluminum alloys, as well as inexpensive aluminum casting alloys such as 319 and 333 series.

Example 3

Another Exemplary Embodiment of the Present Invention

Figure 8:
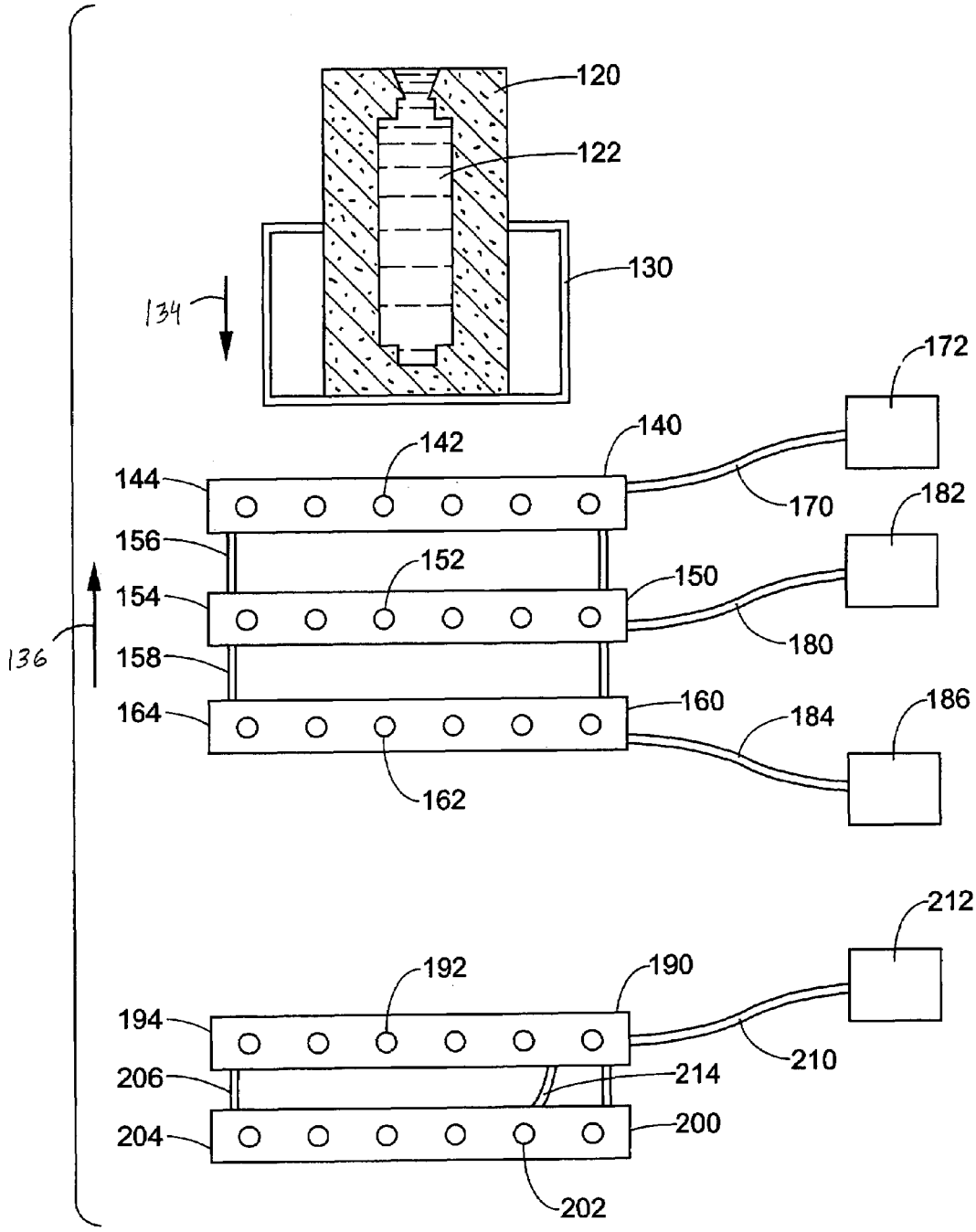

With reference now to FIG. 8, still another embodiment of the present invention comprises a mold 120 which holds molten metal 122. The mold can be held in a frame 130 that is made, for example, of a plurality of bars so that the solvent can penetrate the frame and abrade away or dissolve the material of the mold 120, and so that the abraded particles of the mold can fall away from the frame. In this embodiment, the mold 120 can be filled as in the embodiments of FIGS. 2 and 3 via gravity filling as from a crucible or ladle, or in any other conventional manner. In this embodiment, the mold is moved downwardly towards a first set of spray bars as illustrated by arrow 134. Alternatively, the set of spray bars can be translated upwardly as illustrated by arrow 136. In addition, while not shown, the mold can also be rotated and translated, if so desired, by conventional means.

The spray mechanism according to the present invention comprises a first spray bar 140 which can have mounted to it a plurality of spray nozzles 142 held in a common housing 144. Illustrated in FIG. 8 are six spray nozzles 142. Of course, any other suitable number of nozzles could be used. These can be spaced from each other at spacings of anywhere from ¼ inch to 1 inch (0.64 to 2.54 cm). Spaced from the first spray bar 140 is a second spray bar 150 which can also comprise a plurality of spray nozzles 152 held in a common second housing 154. The second housing may be spaced from the first housing by anywhere from ¼ inch to 6 inches (0.64 to 15.2 cm) by suitable conventional spacer elements 156. Spaced from the second spray bar 150 is a third spray bar 160 which can also have a plurality of spray nozzles 162 held in a common housing 164. The nozzle spacing of the spray nozzles in the second and third spray bars can be approximately the same distances as set forth in connection with the first spray bar, or different distances. Also, the third spray bar can be spaced from the second spray bar by approximately the same amount as the first and second spray bars are spaced from each other, or some other desired distance.

Supplying fluid to the first spray bar 140 is a first supply pipe 170 that is fed by a first source 172. The fluid can be, for example, hot water at about 150° F. (65.6° C.) at a rate of about 8–10 gallons per minute (30.3 to 37.9 liters per minute). Of course, it should be recognized that other types of fluid at other rates and temperatures can also be employed. In the embodiment illustrated, the second spray bar sprays ambient temperature water at a rate of anywhere from 20 to 30 gallons per minute (75.8 to 113.6 liters per minute) as fed by a second supply pipe 174 from a second fluid supply 176. The third spray bar sprays ambient temperature water at a rate of anywhere from 10 to 15 gallons per minute (37.9 to 56.8 liters per minute) as fed by a third supply pipe 180 from a third supply source 182. While the fluid for all three spray bars is indicated to be water, it is apparent that different types of fluids can be employed for the various spray bars if so desired. Moreover, the fluids can be sprayed at different temperatures as well.

In order to obtain the different rates of spray, i.e. anywhere from 8 gallons to 30 gallons (30 to 113.6 liters per minute) that are sprayed by the various spray bars, either the amount of spray nozzles can be decreased or increased as necessary, or the volume of flow through the spray nozzles themselves can be suitably adjusted as is well known in the art. Alternatively, conventional pumps (not shown) which communicate with the various fluid supply lines can be suitably regulated to achieve the desired flow rates. Rates of spray would be changed for various casting thicknesses, various binders used and would be dependent on the casting modulus and the solidifying alloy's composition.

The feed rate of the mold as it is moved downwardly towards the first set of spray bars can be on the order of 0.01 to 1 inch per second (0.025 to 2.54 centimeters per second) as may be desired for the thickness of the casting, as well as the particular type of metal being cast and the specific composition of mold.

With continuing reference to FIG. 8, additional spray bars can also be employed, located beneath the first set of spray bars. Illustrated is a fourth spray bar 190 which comprises a plurality of spray nozzles 192 mounted to a common housing 194. Spaced from the fourth spray bar can be a fifth spray bar 200 which is similarly provided with one or more spray nozzles 202 held in a common housing 204. While in the drawing the same amount of spray nozzles (6) is illustrated, it is evident that any suitable desired number of spray nozzles can be employed for any of the various spray bars 140, 150, 160, 290 and 200 discussed herein. These spray nozzles are fed by a fourth supply line 210 connected to a fourth source 212. The source can be ambient temperature water.

The spray nozzles for all of the various spray bars mentioned heretofore can each have a capacity of about ½ gallon per minute (1.9 liters per minute) and have a fan spray pattern that broadcasts the fluid being sprayed in about a 30° pattern.

The metal poured in the test specimen of the apparatus illustrated in FIG. 8 was of A356 aluminum. The third specimen was formed, twice, by heating the aluminum to a temperature of about 1350° F. It was formed once in a gas-fired crucible and another time in an electric heated crucible. The first time, the aluminum was poured into an ambient temperature mold that was composed of an aggregate silica sand having an average grain size of about 150 micrometers using a binder of phosphate. The second time, the aluminum was poured into a silica sand with the same average grain size using a binder of magnesium sulfate. Each mold, during pour, was held at ambient temperature. Immediately after the molten metal was poured, within 10 seconds after the mold was filled, the spraying process began with the solvent which, as mentioned, was water.

By subjecting a mold that has a soluble binder to a solvent, the mold is dissolved, simultaneously causing the casting to solidify and cool. In this manner, a substantially cooled casting that has been separated from its mold is achieved rapidly. The present invention allows the mold to only define the shape of the cast product and limit the extraction of heat or to extract substantially no heat from the casting. The extraction of heat is carried out by the controlled process of freezing the casting with a solvent in a directional manner to promote the maximum properties and stress relief of the casting. By carrying out the heat extraction in a separate step, the filling of the mold, whether by gravity pouring, tilt pouring, or by counter gravity filling, encourages flow of the molten metal while minimizing premature solidification, allowing castings of complex geometry or thin sections to be achieved.

The application of a solvent need not be via a nozzle. One could, for example, direct the solvent to the mold via an impeller, over a waterfall, or other means. Furthermore, it is conceivable that a binder and solvent combination could be developed of such effectiveness that the mold could be removed without rapid movement of the solvent, such as by dipping the mold into a bath of the solvent. Thus, while one means of applying the solvent is via a nozzle, other means are also conceivable.

Also, the nozzle pressure, the volume of solution sprayed, the direction of travel of the solution in relation to the mold (for example: 1. the nozzle moving and the mold being stationary; 2. the mold moving and the nozzle being stationary; or 3. both the mold and the nozzle moving, either simultaneously or at discrete time intervals), as well as other parameters, can be dependent on either the size or type of part produced, or both. For example, different settings will be required when manufacturing vehicle wheels than when producing smaller vehicle suspension components.

As in the above examples, metal castings typically include risers that allow molten metal to be fed to the castings as they cool and shrink, thereby reducing any voids caused by the shrinkage. Once a casting has cooled, the riser must be cut off. With the present invention, at least one jet of solvent may be designed to deliver solvent at a rate, volume and area sufficient to cut the riser off, thereby eliminating an additional process step of the prior art.

Further, the process, molds and equipment involved are low cost and environmentally friendly. Castings may be produced with a good surface finish and desirable mechanical properties in a rapid and economical manner, while the constituents of the mold may be reclaimed for further use.

While in FIGS. 2 and 3, a gravity feed system is illustrated employing a crucible or ladle 32, it should be appreciated that a pressure assist feeding system could also be employed to feed molten metal into the mold. A variety of conventional pressure assisted feeding systems are known in the art.

In the foregoing paragraphs, mention was made of decomposing the mold. It should be appreciated that the entire mold does not need to be decomposed or removed in the process according to the present invention. All that is needed is removal of at least a portion of the mold, wherein the step of removing the mold begins before the step of solidifying the molten metal has been completed. The portion of the mold removed can be one side of the mold or, for example, a bottom section of the mold on all sides thereof. For example, all four sides of a rectangular mold can be removed or decomposed.

In the above specification, mention was made of the solvent delivery rate ranging from about 0.5 to about 50.0 liters per second. It should be appreciated that the rate of solvent delivery can either be constant or it can be varying, as desired. For example, for certain metals and certain molds, it may be advantageous to vary the rate of solvent delivery, whereas for other types of metals or molds, a constant rate of delivery would be beneficial. Similarly, it was stated in the specification that the solvent delivery pressure can range from about 0.03 bar to about 70.00 bar. It should be appreciated that the pressure of solvent delivery can be varied or can remain constant. It is apparent to one of ordinary skill in the art that conventional pumps can be employed which can be suitably regulated to achieve the desired fluid delivery rates and pressures, whether they be varying or constant.

The invention has been described with reference to preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A process for the casting of metals, comprising the steps of:

providing a mold including an aggregate;

delivering a molten metal into the mold;

solidifying the molten metal; and, removing at least a portion of the mold, including at least a portion of the aggregate, wherein the step of removing at least a portion of the mold begins before the step of solidifying the molten metal has been completed.

2. The process of claim 1, wherein the steps of removing at least a portion of the mold and solidifying the molten metal are performed approximately simultaneously.

3. The process of claim 1, further comprising the step of continuing to deliver molten metal to the mold during the step of removing at least a portion of the mold.

4. The process claim 1, wherein the step of removing at least a portion of the mold includes the step of decomposing the mold.

5. The process of claim 1, wherein the step of delivering molten metal into the mold is accomplished by a gravity feed of the molten metal.

6. The process of claim 1, wherein the step of removing at least a portion of the mold includes the step of spraying the mold with a solvent.

7. The process of claim 6, wherein the step of spraying the mold with a solvent includes the step of adjusting at least one of a rate of spray of the solvent and a pattern of spray of the solvent.

8. The process of claim 6, wherein the step of spraying the mold with a solvent includes the step of directing at least two streams of solvent onto the mold.

9. The process of claim 8, wherein a first stream of solvent is directed onto the mold at at least one of a different time and a different location than a second stream of solvent.

10. The process of claim 6, wherein the solvent includes at least one of a liquid, a gas and a grit material.

11. The process of claim 6, wherein the solvent is delivered at a rate of from about 0.5 to about 50.0 liters per second.

12. The process of claim 6, wherein the solvent is delivered at a pressure of from about 0.03 to about 70.00 bar.

13. The process of claim 6, wherein the mold includes at least one constituent, and the process further comprises the additional step of reclaiming at least one of the at least one constituent and the solvent.

14. A process for reducing the cooling time of a metal that has been cast, comprising the steps of:

providing a mold;

supplying molten metal to the mold;

spraying the mold with a solvent;

decomposing at least a portion of the mold with the solvent; and, cooling the molten metal with the solvent, wherein the step of spraying commences before the molten metal has completely solidified.

15. The process of claim 14, wherein the step of spraying commences shortly after the molten metal has been poured into the mold.

16. The process of claim 14 further comprising the step of supplying additional molten metal to the mold during said step of spraying the mold with the solvent.

17. The process of claim 14, wherein the step of spraying the mold with a solvent includes delivering the solvent at a rate of from about 0.5 to about 50.0 liters per second.

18. The process of claim 14, wherein the step of spraying the mold with a solvent includes delivering the solvent at a pressure of from about 0.03 to about 70.00 bar.

19. The process of claim 14, wherein the mold includes a binder and an aggregate, and further comprising the additional step of reclaiming at least one of the binder, aggregate and solvent.

20. The process of claim 14, wherein the step of spraying the mold with a solvent includes the step of adjusting at least one of a rate of spray of the solvent and a pattern of the spray of the solvent.

21. The process of claim 14, wherein the step of spraying the mold with a solvent includes the step of directing at least two streams of solvent onto the mold.

22. The process of claim 21, wherein the at least two streams are spaced from each other so as to contact separate areas of the mold.

23. A process for casting an aluminum metal, comprising:

providing a mold;

delivering a molten aluminum metal into the mold; and, decomposing at least a portion of the mold at an elevated temperature with a solvent including water, wherein the step of decomposing at least a portion of the mold begins before the molten aluminum metal has completely solidified into a casting.

24. The process of claim 23, further comprising continuing to deliver molten metal to the mold during the step of decomposing at least a portion of the mold.

25. The process claim 23, wherein the step of decomposing at least a portion of the mold includes percolating the solvent through the mold.

26. The process of claim 23, wherein the step of decomposing at least a portion of the mold includes spraying the mold with the solvent.

27. The process of claim 26, wherein the step of spraying the mold with the solvent includes adjusting a rate of spray of the solvent.

28. The process of claim 26, wherein the step of spraying the mold with the solvent includes adjusting at least one of a pattern of spray of the solvent and a rate of spray of the solvent.

29. The process of claim 26, wherein the step of spraying the mold with the solvent includes directing at least two streams of solvent onto the mold.

30. A process for reducing the cooling time of a metal that has been cast, comprising:

providing a mold;

supplying a molten metal including aluminum to the mold to form a cast metal;

percolating a solvent including water through the mold to the cast metal;

forming a relatively solid skin on the cast metal while an interior thereof remains molten; and, subsequently contacting the relatively solid skin on the cast metal with the solvent.

31. The process of claim 30 further comprising cooling the cast metal with the solvent.

32. The process of claim 30, further comprising continuing to contact the cast metal with the solvent until the cast metal has completely solidified.

33. The process of claim 32, wherein the step of contacting commences shortly after the step of forming a relatively solid skin on the cast metal.

34. The process of claim 30 further comprising the step of supplying additional molten metal to the mold during said step of contacting the relatively solid skin with the solvent.

35. The process of claim 30, wherein the step of contacting the relatively solid skin with the solvent includes the step of adjusting at least one of a rate of contact of the solvent and a pattern of contact of the solvent.

36. The process of claim 30, wherein the step of contacting the relatively solid skin with the solvent includes directing at least two streams of solvent onto the relatively solid skin.

37. The process of claim 36, wherein the at least two streams are spaced from each other so as to contact separate areas of the relatively solid skin.

38. A method of removing a mold including an aggregate from a casting which is being formed therein, comprising:

directing a fluid stream at the mold when the casting is partially solidified; and dislodging at least a portion of the aggregate of the mold from the casting.

39. The method of claim 38 further comprising continuing to deliver molten metal to the mold during the step of dislodging at least a portion of the mold.

40. The method of claim 38 wherein the step of directing a fluid stream comprises percolating a solvent including water through the mold.

41. The method of claim 40 further comprising subsequently spraying the solvent at the casting.

42. The method of claim 38 wherein the step of directing a fluid stream comprises spraying the mold with a solvent including water.

43. The method of claim 42 wherein the step of spraying the mold with the solvent includes adjusting at least one of a rate of spray of the solvent and a pattern of spray of the solvent.

44. The process of claim 42, wherein the step of spraying the mold with a solvent includes directing at least two streams of solvent onto the mold.

45. The process of claim 44, wherein the at least two streams are spaced from each other so as to contact separate areas of the mold.

46. The process of claim 38 further comprising reclaiming at least one constituent of the mold.

* * * * *